United States Patent [19]

Gale

[11] 4,228,745

[45] Oct. 21, 1980

[54] VARIABLY-ORIENTED FOOTSTOOL

[76] Inventor: Vernon M. Gale, 2021 N. Rockingham St., McLean, Va. 22101

[21] Appl. No.: 935,996

[22] Filed: Aug. 23, 1978

[51] Int. Cl.[2] ..... A47B 9/04; A47B 3/08; A47C 3/24

[52] U.S. Cl. ..... 108/116; 108/7; 108/147; 248/188.4; 248/422; 297/439

[58] Field of Search ..... 108/6, 7, 4, 116, 127, 108/147, 144; 248/371, 396, 157, 422, 188.4, 188.5, 188.2; 297/438, 439, 461, 348, 362

[56] References Cited

U.S. PATENT DOCUMENTS

| | | | |
|---|---|---|---|
| 172,674 | 1/1876 | Tyler | 297/461 |
| 331,297 | 12/1885 | Hall | 248/188.4 |
| 789,813 | 5/1905 | Longley | 297/439 X |
| 1,116,091 | 11/1914 | McDonald | 108/144 X |
| 1,573,691 | 2/1926 | Eichberg | 108/144 X |
| 2,528,331 | 10/1950 | Bell | 297/439 |
| 2,621,992 | 12/1952 | Anderson et al. | 108/127 |
| 3,580,634 | 5/1971 | Bock | 297/439 X |
| 3,859,930 | 1/1975 | Sherwin | 297/439 X |

FOREIGN PATENT DOCUMENTS

| | | | |
|---|---|---|---|
| 132269 | 3/1933 | Austria | 297/439 |
| 21552 | of 1894 | United Kingdom | 248/422 |
| 20671 | of 1909 | United Kingdom | 248/371 |

*Primary Examiner*—William E. Lyddane
*Attorney, Agent, or Firm*—Sherman & Shalloway

[57] ABSTRACT

A footstool is disclosed which is variable in both its height and its slope to accommodate the varying needs of individuals who are required to hold a leg in an elevated position for extended periods of time and are, therefore, prone to fatigue of the leg, back and other portions of the body. The stool includes a main body portion having adjustable legs at each end and which may be hinged to the main body portion for convenience in transport and storage. Each of the legs is formed of a base portion and a portion fixed to the main body of the stool with an infinitely-variable adjustment member such as a screw anchored in one of the leg portions and a mating nut mounted in the other of the leg portions. Preferably, the legs extend downwardly from the main body at diverging angles, in their use position, to enhance the longitudinal stability of the stool. Lateral stability and overall stability are provided by widely separated guides in each leg which provide both lateral and longitudinal guidance and bracing on both sides of each of the leg adjusters. The leg portions which are fixed with respect to the main body portion may be latched in their use position to provide an essentially rigid joint between the main body and that portion of the leg.

10 Claims, 3 Drawing Figures

VARIABLY-ORIENTED FOOTSTOOL

BACKGROUND OF THE INVENTION

The present invention relates to adjustable footrests and is concerned, more particularly, with variable-height and variable-slope footstools for services requiring extended periods of use in achieving exact body positions such as those required of classical guitarists.

Classical guitarists or guitarists practicing or working in a sitting position spend quite lengthy periods of time in that position with the instrument resting on one knee or upper leg portion. It is considered preferable, by several authorities, to sit in a relatively high, straight chair and to elevate the instrument-carrying leg by resting that foot on a stool whose height is proportional to that of the seat, thus providing three points of support for the guitar in a balanced state so that the hands are free of a basic need to support the instrument and thus unencumbered in their manipulation of the sounding portions of the guitar.

The basic reason for the use of a footstool in these circumstances is to raise the thigh of the guitar-support leg into a sloping position in which there is no tendency of the guitar to slide toward the knee and, more importantly, to raise the instrument into the optimum position for the player. This position or height can vary considerably with the relative lengths of the player's torso and arms, the thickness of his thigh, the peripheral contour of the instrument and the most comfortable general attitude of his body in the sitting position. Too high a leg position can cramp the instrument into the abdomen of the player, for example, dampening resonation of the back of the guitar while too low a leg height can cause problems in fingering the instrument, particularly with the left hand, in the case of a right-handed musician. The problems are aggravated when encountering chairs of varying height or of adjustable height, such as piano stools.

The use of a footstool, however, inherently causes a degree of tilt of the pelvis of the player, so that any excess in elevation of the foot can also tend to result in a body position tending to compensate for the tilt by tilting of the raised leg or even of the whole body itself.

Any strained or tense position of a guitarist's body will, of course, result in fatigue, a condition which can only result in a progressive deterioration in his musical performance. Muscle trembles can cause tremulo effects at times which are quite inappropriate, while tiring or aching will cause lack of dexterity, accuracy and optimum performance of the musician.

Therefore, it is apparent that a unique need exists for a footrest which is fully adjustable in both height and slope to accommodate the unique physical needs of each guitarist using the sitting position.

PRIOR ART STATEMENT AND DISCUSSION

The prior art of which I am aware and which is believed to be the most relevant to my present invention includes the following U.S. Patents:

U.S. Pat. No. 172,674 to Tyler
U.S. Pat No. 789,813 to Longley
U.S. Pat. No. 2,528,331 to Bell
U.S. Pat. No. 3,580,634 to Bock
U.S. Pat. No. 3,859,930 to Sherwin U.S. Pat. No. 172,674 discloses the broad concept of using foldable and stowable legs at opposite ends of a footstool.

U.S. Pat. No. 789,813 discloses a footrest which is adjusted in height and angle by means of racks which are engaged by pins at different points along the length of the racks.

U.S. Pat. No. 2,528,331 discloses a footstool which is adjustable in tilt by means of a segment of a ring which has fixed apertures at different positions to receive locking pins.

U.S. Pat. No. 3,580,634 discloses a seat which accommodates the unique needs of a drummer by means of a screwbolt which changes the tilt of the seat portion.

U.S. Pat. No. 3,859,930 discloses a tiltable tray having several notches for receiving locking pins to secure the desired tilt.

In addition to the above patents, I am aware of a footstool which is currently available and which employs the scissors principle to achieve varying height of the stool at three different positions.

However, none of these prior attempts in the provision of adjustable footrests are capable of meeting the unique needs of seated guitarists or achieving the objects of the present invention.

SUMMARY OF THE INVENTION

In general, the preferred form of the present invention comprises a footrest having an elongate body portion carrying adjustable-length legs at each end, the legs being substantially infinitely variable over their range of adjustment and having pairs of guides which are widely spaced from each other transversely of the length of the leg and on opposite sides of the adjusting mechanism. Preferably, the legs engage the body portion at downwardly-diverging angles by means of hinges and have means for locking them in their divergent, use position.

OBJECTS OF THE INVENTION

It is an object of the present invention to provide a compact footrest which is adjustable in both height and slope and which is infinitely variable within its ranges of height and slope.

It is an object of the present invention to provide a compact footrest which is infinitely variable in ranges of height and slope and stable in both its longitudinal and its lateral axes.

It is an object of the present invention to provide a compact footrest which is infinitely variable in its ranges of height and slope and which includes guides stabilizing the adjustable portions thereof against longitudinal and lateral flexing.

It is another object of the present invention to provide a compact and portable footrest which is infinitely variable in ranges of height and slope and which includes adjustable legs hinged at opposite ends of the rest and having parallel, spaced guides flanking their adjusting mechanism.

It is another object of the present invention to provide a compact and portable footrest which is variable in ranges of height and slope and which includes legs hinged at opposite ends of the rest, the legs including infinitely variable adjusting means for changing the length thereof and spaced, elongate guides on opposite sides of the adjusting means and locking means for locking the legs in a use position with regard to the body of the rest.

It is a particular object of the present invention to provide a compact and portable footrest for guitarists which includes an adjustable leg at each end thereof with each leg having an adjusting screw and nut respectively mounted on movable leg portions and a pair of channel guides on opposite sides of the adjusting screw and parallel thereto to stabilize the two leg portions with regard to each other and with regard to the main body of the footrest.

BRIEF DESCRIPTION OF THE DRAWINGS

These and other objects of the invention, as well as a better understanding thereof, may be derived from the following description and the accompanying drawings, in which.

DETAILED DESCRIPTION OF THE PREFERRED EMBODIMENT

Figure 1:
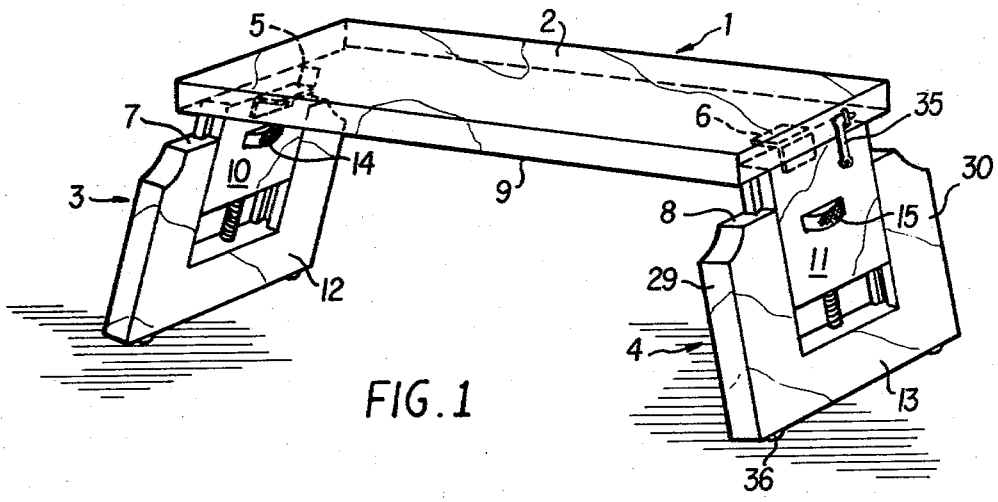
FIG. 1 is a perspective view of the preferred form of guitarist's footrest according to the invention.

As shown in the drawings, the preferred form of guitarist's footstool or footrest according to the invention comprises a main body portion 1 having a flat upper surface 2 for receiving and supporting the guitarist's foot and is itself supported on a pair of legs 3 and 4, respectively, which are positioned at opposite ends thereof.

Preferably, the legs 3 and 4 are secured to the body portion 1 by means of individual hinges 5 and 6, respectively, in a manner permitting the legs to be folded toward each other between the ends of the body portion, for transport or storage, and further permitting the legs to extend beyond the adjacent ends of the body portion so that they mutually diverge from each other when they are extended into the use position shown in FIG. 1. The upper edges of the hinged portions of the legs 3 and 4 are preferably bevelled, at 7 and 8, respectively, to lie flat against the underside 9 of the body portion to provide a bearing or supporting joint between the body and the legs when they are extended to the support position.

The legs 3 and 4 each include a center portion 10 and 11, respectively, which is relatively fixed with regard to the body portion by the associated hinge 5 or 6. The legs each further include a U-shaped portion 12 and 13, respectively, which is movable relative to the adjacent fixed portion or center portion 10 or 11 by means of longitudinal adjusting or screw means 14 and 15, respectively, which are positioned substantially at the midpoint of the width of the legs 3 and 4.

Figure 2:
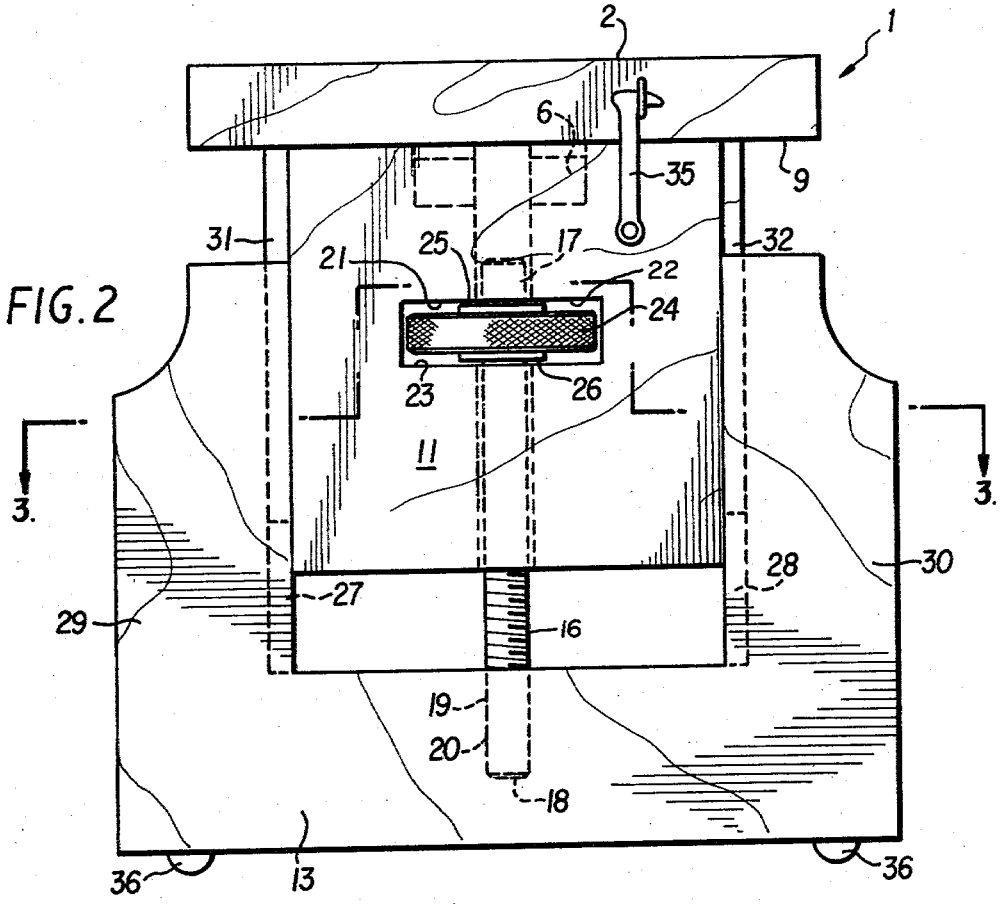
FIG. 2 is an end view of the footrest of FIG. 1 on an enlarged scale.
Figure 3:
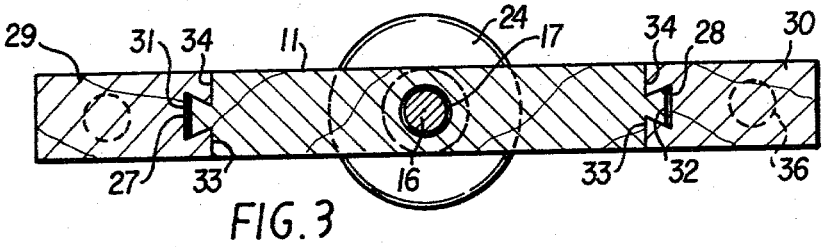
FIG. 3 is a sectional view taken on line 3—3 of FIG. 2.

Each of the adjusting means 14 and 15 includes an elongate screw member 16 positioned within a cylindrical bore 17 within its associated center portion 10 or 11 and engageable against the bottom 18 of a cylindrical recess 19 aligned therewith in the associated U-shaped portion 12 or 13. The screw member is secured in its recess 19 by suitable means preventing its rotation, such as glue, a crosspin, or the threads 20 shown in FIG. 2 or a combination thereof.

Each center portion 10 and 11 has a slot 21 therethrough substantially at right angles to the axis of the adjacent cylindrical bore 17 and having upper and lower bearing surfaces 22 and 23 also substantially at right angles to the bore 17. A knurled nut 24 is positioned on each screw member 16 within the associated slot 21 and includes upper and lower bearing surfaces 25 and 26 extended from the main portion of the nut and spaced apart a distance slightly less than the distance between the bearing surfaces 22 and 23 to provide a tolerance permitting rotation of the screw member within the slot.

Each U-shaped leg member includes a pair of dovetail guide grooves 27 and 28 individually positioned in one of the upper arms 29 and 30 of the U-shaped member. The grooves are parallel to each other and mutually parallel to the axis of their adjacent screw member 16. Each center leg portion includes a pair of dovetail longitudinal ridges 31 and 32 positioned and dimensioned to slide with the adjacent groove in the U-shaped member. The ridges and grooves are thus interlocked laterally and have a close, bearing-type fit to serve as guide means flanking the adjusting screw means at positions widely separated from the center of the leg assembly to provide a wide stance or lines of engagement between the respectively fixed and movable leg portions.

As shown, the grooves and the ridges preferably are dovetail shaped in cross-section and are themselves flanked by flat bearing surfaces 33 and 34, respectively, which further aid in providing a bearing means against lateral flexing of the adjacent fixed and movable leg portions. It is to be understood, however, that different cross-sectional shapes of grooves and ridges may be employed, as desired, as long as they are close-fitting and cooperative in shape and are aligned parallel to their associated screw means so that the screw means may have sufficient transverse tolerance to permit free operation thereof without imposing an instability to the footrest as a consequence of that tolerance and free operation.

The center portions of the legs advantageously are provided with lock means, such as the shutter-latches 35, to retain the legs in their fully-extended position for use, so that the footrest is not only further stabilized thereby, but also may be carried or repositioned without losing the full extension position of the legs. For purposes of securing the position of the footrest on the floor or stage, it is also desirable to provide several resilient cushions or rubber feet 36 at spaced points which are uniformly distributed with regard to the overall footrest structure.

In use, the new footrest achieves its objectives and provides a uniquely advantageous tool for guitarists using the classical position. The screw adjustments provide a stepless, infinitely variable control of the height and shape of the unit. The rigidly-fixed screw, acting through the close-fitting receiving bore 17 provide sound joints between the fixed and movable portions of the legs, while the flanking guides provide a wide stance bracing against lateral flexure of the unit.

With the preferred, dovetail form of guide, the tapered surfaces of the groove and ridge add an interlocking function against outward-deflection of the upper arms 29 and 30 with regard to the base of the U-shaped member, so that the joints therebetween are not overstressed to add a component of looseness or undesired motion to the unit. This factor is of increased importance where the U-shaped member is formed of wood, since it is desired to have the center portions 10 and 11 and their hinges 5 and 6 as wide as practicable with regard to the width of the body portion 1.

The wide center portions of the legs 3 and 4 not only provide for stability of the unit, but also permit the use of a relatively large diameter of the adjusting nuts 24, which is highly desirable since guitarists rely on long, relatively delicate fingernails which are susceptible to breakage. The large knurled adjusting wheel or nut makes it quite easy to adjust the new footrest with a minimum chance for nail damage.

While wood is preferred as the stock material for main portions of the new footstool, it is to be understood that any desired material or combination of materials may be used. The screws and adjusting nuts preferably are of steel, but may be formed of other hard materials.

Therefore, it is apparent that the present invention has provided a novel footrest which accomodates the desirability of accurate adjustment of both height and slope and which meets the unique problems and needs of classical guitarists.

Various changes may be made in the details of the invention, as disclosed, without sacrificing the advantages thereof or departing from the scope of the appended claims.

What is claimed is:

1. A variable footstool comprising:

(a) a main body position, (b) a leg at each end of said main body portion, each leg including, (c) a first leg portion secured to said main body portion and having a longitudinal bore therein and a slot therethrough, the slot being perpendicular to the bore; and (d) a second leg portion longitudinally movably mounted with respect to said first leg portion, with (e) adjusting means for infinite variation of the relative positions of said first and second leg portions, and (f) at least one longitudinal guide means on said first and second leg portions parallel to the longitudinal bore, (g) said adjusting means comprising a member slidably located within the bore and having one end secured to said second portion, and a means for engaging the member located within the slot and engaging the member.

2. The footstool of claim 1 in which said first leg portion is secured to said main body portion by hinge means.

3. The footstool of claim 1 in which said member is comprised of an adjusting screw and said means for engaging is a nut threadably engaging the adjusting screw.

4. The footstool of claim 1 in which one of said first and second leg portions is generally U-shaped and receives the other of said leg portions in a sliding relationship and said guide means includes a pair of guides, each positioned along adjacent sliding portions of said first and second leg portions.

5. The footstool of claim 4 in which said guides include a groove and a guide member received in said groove.

6. The footstool of claim 5 in which said groove and said guide members each have a pair of adjacent bearing surfaces.

7. The footstool of claim 5 in which said guides are generally dovetail-shaped in cross-section.

8. The footstool of claim 5 including hinge means for providing a divergent relationship of said legs with respect to said body portion in a use position.

9. The footstool of claim 8 in which each leg includes an angular surface bearing against the main body portion in its use position.

10. The footstool of claim 9 and including a lock for securing each leg in its use position.

* * * * *